United States Patent [19]

Allen

[11] Patent Number: 4,630,964

[45] Date of Patent: Dec. 23, 1986

[54] SUBGRADING MACHINE

[75] Inventor: J. Dewayne Allen, Paragould, Ark.

[73] Assignee: Allen Engineering Corporation, Paragould, Ark.

[21] Appl. No.: 663,196

[22] Filed: Oct. 22, 1984

[51] Int. Cl.[4] ..... E01C 19/15

[52] U.S. Cl. ..... 404/96; 404/119; 37/108 A; 172/701.3

[58] Field of Search ..... 404/96, 101, 106, 114, 404/118, 119, 120; 37/108 A, 108 R; 172/701.3, 799.5

[56] References Cited

U.S. PATENT DOCUMENTS

| | | | |
|---|---|---|---|
| 985,214 | 2/1911 | Shroyer | 404/119 |
| 1,532,841 | 4/1925 | Stayton et al. | 404/106 |
| 1,768,663 | 7/1930 | Carr | 37/108 A |
| 3,059,357 | 10/1962 | Irish | 172/701.3 |
| 3,680,451 | 8/1972 | Birtchet | 404/104 |
| 4,249,327 | 2/1981 | Allen | 404/114 |
| 4,289,421 | 9/1981 | Sampey et al. | 404/106 |
| 4,314,773 | 2/1982 | Allen | 404/119 X |
| 4,316,715 | 2/1982 | Allen | 425/456 |
| 4,335,976 | 6/1982 | Morrison | 404/114 |
| 4,412,803 | 11/1983 | Allen | 404/119 X |
| 4,544,346 | 10/1985 | Allen | 404/119 X |

FOREIGN PATENT DOCUMENTS

| | | | |
|---|---|---|---|
| 909194 | 1/1960 | United Kingdom | 404/119 |

*Primary Examiner*—Stephen J. Novosad
*Assistant Examiner*—John F. Letchford
*Attorney, Agent, or Firm*—Cahill, Sutton & Thomas

[57] ABSTRACT

A subgrading machine precisely levels and contours the subgrade within an area having first and second parallel oriented forms including parallel upper surfaces vertically spaced above the subgrade and defining a form surface plane. A grading blade extends along the front of a triangular truss frame terminated by first and second end sections and having a length less than the spacing between the forms. The front and rear edges of the frame define a frame base plane. An adjustable end bracket is coupled to each frame end section and includes a form contact element for maintaining a parallel alignment between the frame base plane and the form surface plane. The form contact element is coupled at a selectable vertical position to each end bracket to vary the spacing between the frame base plane and the form surface plane to thereby determine the grading depth of the grading blade. A winch system provides a traction force having an effective horizontal force vector at approximately the same elevation as the grading blade and the subgrade.

19 Claims, 10 Drawing Figures

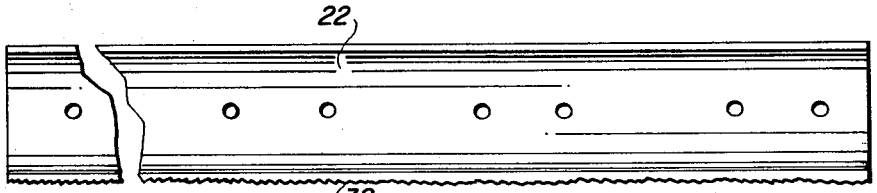
FIG. 3
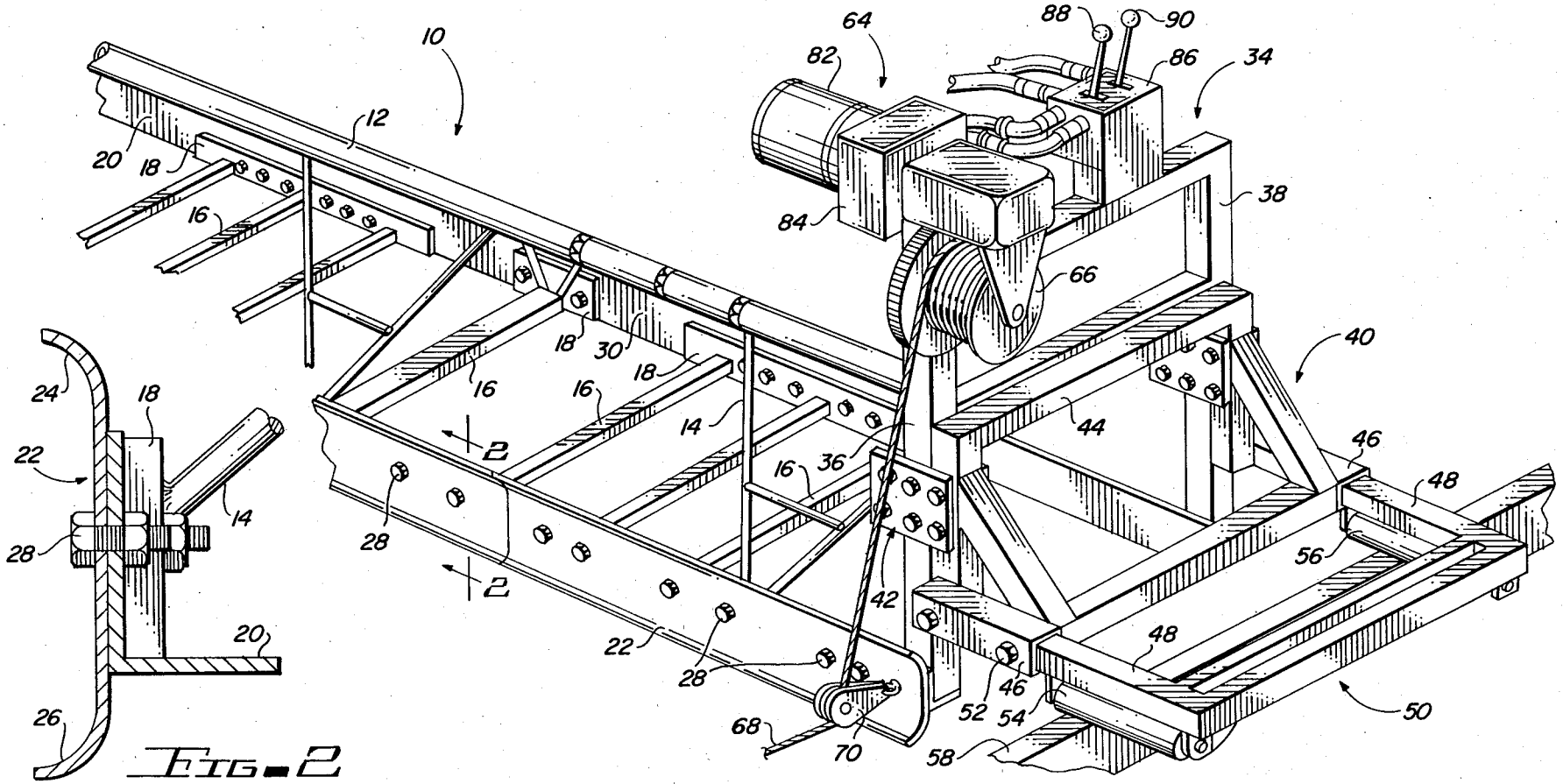
FIG. 1
FIG. 2

SUBGRADING MACHINE

BACKGROUND OF THE INVENTION

1. Field of the Invention

This invention relates to subgrade contouring devices and more particularly, to subgrading machines for precisely levelling and contouring the subgrade within an area having first and second parallel-oriented forms prior to placement of plastic concrete into the area.

2. Description of the Prior Art

The present invention represents a significant improvement of the subgrading machine disclosed in U.S. Pat. No. 4,249,327 (Allen). That patent discloses a subgrading attachment for a triangular truss concrete screed having a frame length greater than the spacing between the parallel-oriented concrete forms which support substantially the entire weight of the screed. A subgrading blade includes a length less than the spacing between the forms and is maintained in a position well below and in front of the screed by a multiple-element bracket. A winch system provides a traction force to the screed frame having an effective horizontal force vector aligned with the front screed blade at an elevation just above the upper surface of the concrete forms and well above the subgrade surface. As this subgrading machine is advanced into the uncontoured subgrade, a substantial drag force is imparted to the subgrade blade at an elevation substantially below the elevation of the forward traction force. The vertical spacing between the traction force vector and the drag force vector creates a lever arm and a resulting torque force which causes the entire subgrading machine to rotate forward as the device is translated into the unfinished subgrade. When using this prior art subgrading machine to contour densely compacted subgrade material, typically one or two workers stand on the rear screed blade to prevent undesired forward rotation or tipping of the machine as it is advanced into the unfinished subgrade material.

FIGS. 7, 11 and 17 of U.S. Pat. No. 4,316,715 (Allen) discloses an adjustable extension bracket for a vibratory concrete screed which can be coupled to the end sections of the screed at a selectable vertical position and which can be laterally telescoped with respect to the screed end section. This adjustable extension bracket is typically used where the forms or curbs on which the screed rides are positioned at a higher elevation than the elevation of the slab to be finished.

SUMMARY OF THE INVENTION

It is therefore a primary object of the present invention to provide a subgrading machine which eliminates the undesirable lever arm and the torque force resulting from operation of the subgrading machine disclosed in U.S. Pat. No. 4,249,327 by applying the grading blade traction force at an elevation substantially aligned with the elevation of the subgrade.

Another object of the present invention is to provide a subgrading machine where virtually the entire weight of the triangular truss frame may be directly applied to the grading blade by shortening the frame length to permit the subgrading machine to fit between the parallel-oriented concrete forms, thereby substantially reducing the weight transfer from the frame to the upper surface of the concrete forms.

Another object of the present invention is to provide a subgrading machine having a significantly lower center of gravity by reducing the vertical spacing between the subgrader machine frame and the subgrade.

Another object of the present invention is to provide a subgrading machine incorporating an outwardly extending adjustable end bracket for contacting the upper surface of parallel-oriented concrete forms to maintain a parallel-orientation between the base of the subgrading machine frame and the top of the forms.

Still another object of the present invention is to provide a subgrading machine including an outrigger bracket coupled to the adjustable end brackets and extending in front of the screed frame to counteract undesirable torque forces.

Briefly stated, and in accord with one embodiment of the invention, a subgrading machine precisely levels and contours the subgrade within an area having first and second parallel-oriented forms. The parallel upper surfaces of the forms are vertically spaced above the subgrade and define a form surface plane. The triangular truss frame of the subgrading machine includes front and rear edges defining a frame base plane and is terminated by a pair of end sections. A grading blade extends along the front edge of the frame. Because the spacing between the opposing forms exceeds the length of the frame, the subgrading machine can be fitted between the forms. An adjustable end bracket is coupled to each end section of the subgrader machine and includes form contact means which can be coupled to each end section at a selectable vertical position to vary the spacing between the frame base plane and the form surface plane to determine the grading depth of the grading blade. A winch system advances the machine into the uncontoured subgrade and includes a pair of winches and pulleys which transfer the effective horizontal traction force exerted by the winches on the subgrading machine frame to an elevation substantially aligned with the elevation of the grader blade.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIG. 1 is a partially cutaway perspective view of the subgrading machine of the present invention.

FIG. 2 is a partially cutaway sectional view of the subgrading machine illustrated in FIG. 1, taken along section line 2—2.

FIG. 3 is a partially cutaway elevational view of one embodiment of a grading blade including a serrated grading edge.

FIG. 6 further depicts a trench grader attachment for increasing the subgrade depth in areas adjacent to the concrete forms.

DESCRIPTION OF THE PREFERRED EMBODIMENT

In order to better illustrate the advantages of the invention and its contributions to the art, a preferred hardware embodiment of the invention will now be described in detail.

Figure 5:
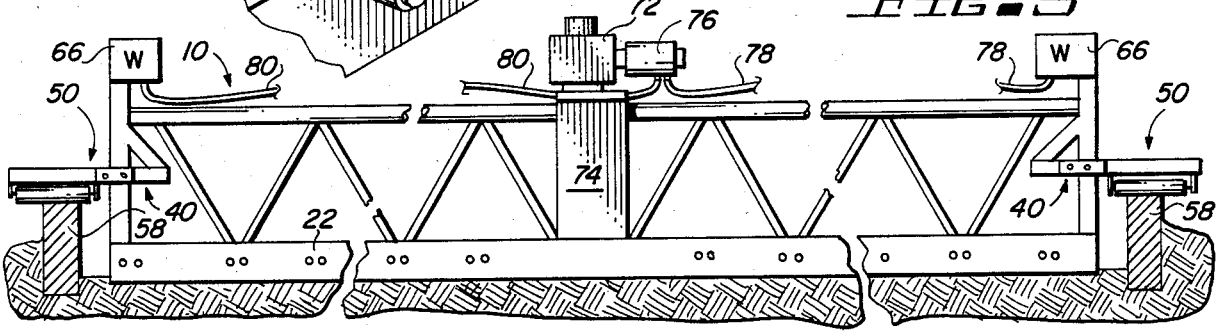
FIG. 5 is a simplified, partially cutaway elevational view depicting the relative position and alignment of the subgrading machine of the present invention with respect to the adjacent concrete forms and underlying subgrade.
Figure 6:
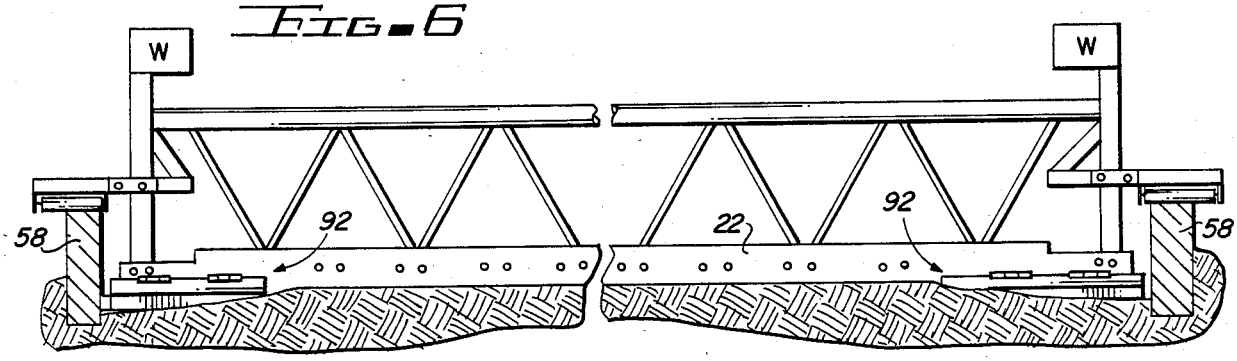
FIG. 6 is a simplified, partially cutaway elevational view depicting the relative position and alignment of the subgrading machine of the present invention with respect to the adjacent concrete forms.
Figure 7:
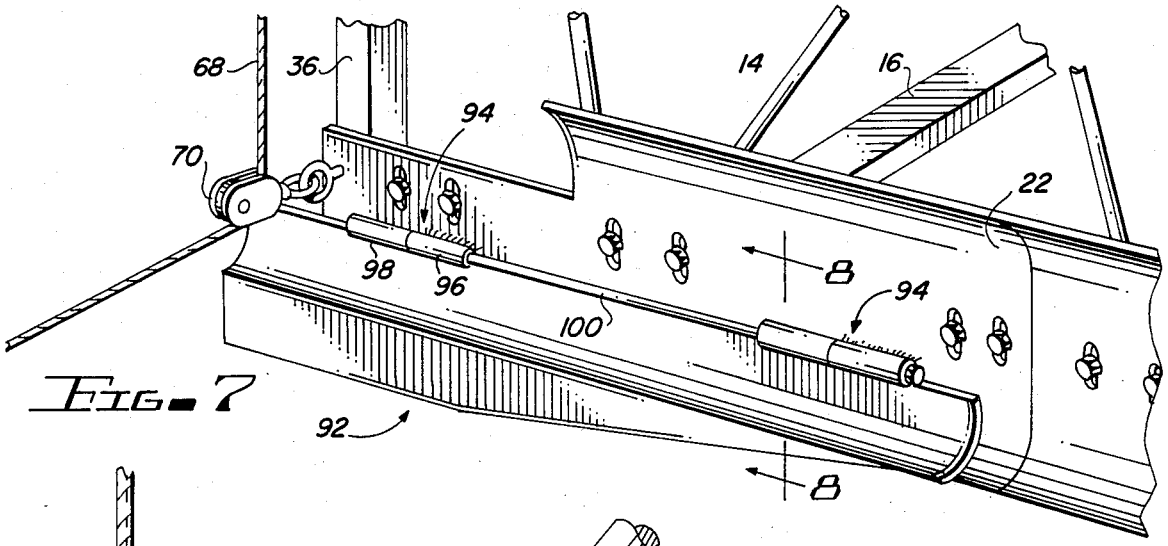
FIG. 7 is a partially cutaway perspective view depicting a subgrading machine incorporating a trench grader attachment.
Figure 8:
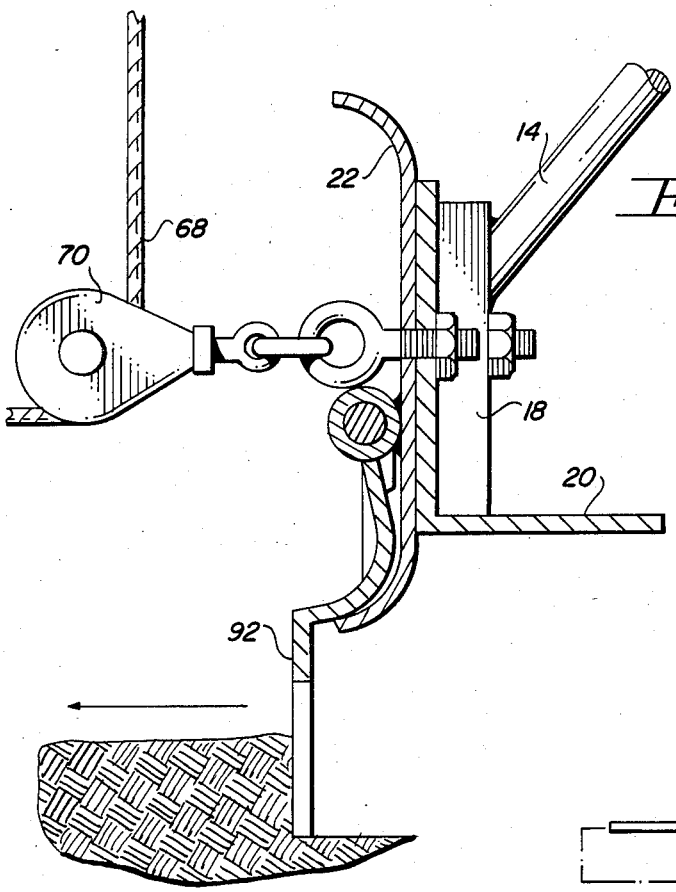
FIG. 8 is a sectional view of the subgrading machine including the trench grader attachment depicted in FIG. 7, taken along section line 8—8.

Referring now to FIGS. 1, 2 and 5, the subgrading machine of the present invention includes a triangular truss frame 10 of a type which has been commercially available from the Allen Engineering Corporation of Paragould, Ark. for many years. This frame includes an upper support element 12, a plurality of angled struts 14 and a plurality of horizontally oriented struts 16 which are secured either singly or in groups to blade attachment brackets 18. Each of these spaced apart blade attachment brackets lying along the front and rear edges of frame 10 are coupled together by a length of channel metal as designated in FIG. 2 by reference number 20. A grading blade 22 includes a forward curved upper section 24 and a forward curved lower section 26 which is a mirror image of upper section 24. Securing means in the form of bolts attach grading blade 22 to frame 10 by penetrating blade 22 and channel metal 20 or by penetrating blade 22, channel metal 20 and blade attachment brackets 18, depending upon the relative position of bolts 28 along frame 10. Channel metal 20 serves as a backing plate for reinforcing and supporting grading blade 22. Grading blade 22 may be fabricated in a single continuous length, but more typically is fabricated in sections having a length compatible with the two and one half, five, and seven foot frame sections which are jointed together end to end to form a triangular truss frame 10 of a desired length.

Blade 22 is fabricated with the symmetrical, curved upper and lower sections as depicted in FIG. 2 for two reasons. First, the symmetrical configuration of blade 22 permits the blades to be inverted, reversing the relative positions of sections 24 and 26 as necessary to thereby double the effective life of blade 22 by permitting the unworn upper section 24 of blade 22 to be substituted for lower section 26 of blade 22 after it is worn out. Second, the curved configuration of blade 22 causes subgrade material which has been engaged and cut by lower section 26 of blade 22 to be displaced upward along the front face of the blade and to be rolled forward following discharge from the curved upper section 24 of blade 22.

FIG. 3 depicts a grading blade 22 incorporating a serrated lower cutting edge 32 which provides improved subgrade cutting action for particularly hard subgrade materials. The depicted serrated edge may be fabricated on the lower cutting surface of blade 22 or both on the upper and lower cutting surface of the grader blade.

Each end of frame 10 is terminated by an end section 34 including parallel, vertically oriented support rails 36 and 38.

An adjustable end bracket 40 is coupled to each end section 34 of frame 10. Adjustable end bracket 40 includes vertical coupling means 42 which couples the frame 44 of bracket 40 to support rails 36 and 38. The specific structural configuration of vertical coupling means 42 is illustrated in detail in FIGS. 11 and 17 and the accompanying written disclosure of U.S. Pat. No. 4,316,715 which is hereby incorporated by reference. A pair of horizontally oriented tubes 46 are coupled to the sides of frame 44 and receive the horizontally oriented end pieces 48 of form contact element 50. Securing means in the form of a pair of spaced apart bolts 42 can be loosened to permit relative lateral adjustment between form contact element 50 and the frame 44 of adjustable end bracket 40. Bolts 42 are tightened to maintain a fixed lateral position between those two elements.

Figure 4:
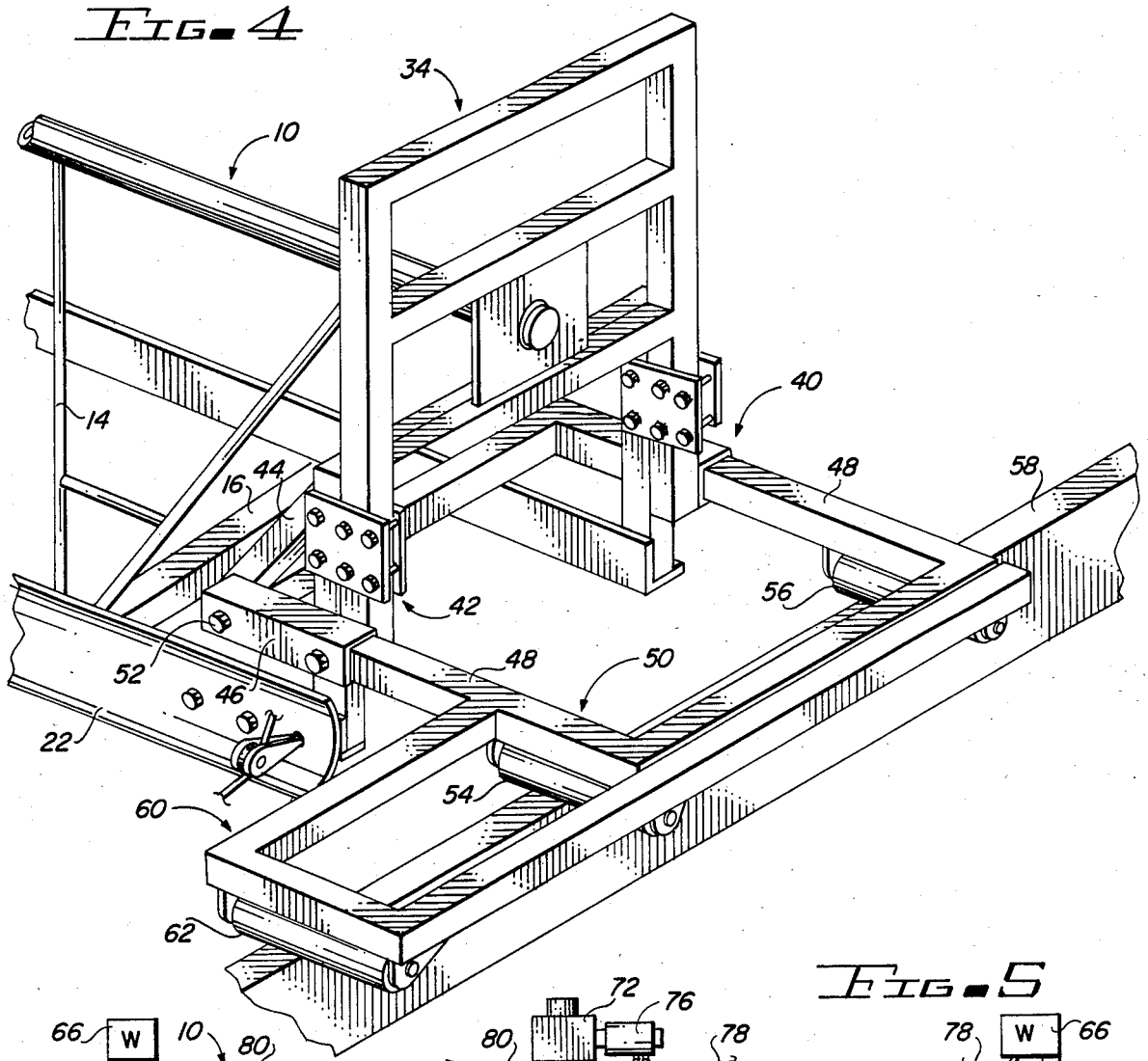
FIG. 4 is a partially cutaway, enlarged perspective view of an end of a subgrading machine of the present invention including an adjustable end bracket with an outrigger bracket.

In the embodiment of the adjustable end bracket 50 depicted in FIG. 1, the lower surface of form contact element 50 includes first roller means in the form of a pair of spaced apart rollers 54 and 56 which provide a low friction, rolling contact between the subgrading machine and the upper surface of concrete form 58. As depicted in FIG. 4, a second embodiment of the adjustable end bracket 40 includes an outrigger bracket 60 which is coupled to the front end of form contact element 50 and incorporates a separate roller 62 for providing low friction engagement with the upper surface of form 58. Outrigger bracket 60 provides additional stability for the subgrading machine by providing additional resistance to torque forces which might tend to rotate the subgrading machine forward as it is translated into unfinished subgrade material.

A winch system 64 is coupled to each end section 34 of frame 10 and includes a mechanical winch 66 and a winch cable 68 which is routed from winch 66 vertically downward through a pulley 70 and then horizontally outward to a fixed attachment point. Pulley 70 is coupled to the lower front surface of end section 34 at an elevation approximately level with the front edge of frame 10 and with the center of grading blade 32. Winches 66 can either be manually powered or hydraulically powered. In the hydraulically powered configuration, an internal combustion engine 72 is coupled to frame 10 by an engine mounting bracket 74. To evenly distribute the system weight, engine mounting bracket 74 will typically be coupled to the central area of frame 10. A hydraulic pump 76 is mechanically attached to engine 72 and its rotating power output shaft. Two pairs of hydraulic hoses, designated by reference numbers 78 and 80, provide a source of pressurized hydraulic fluid to hydraulic motors 82, the mechanical output of which is coupled through a gear reduction box 84 to winch 66. Hydraulic control means 86 includes an on/off valve 88 for actuating hydraulic motor 82 and a flow control valve 90 which controls the output speed of hydraulic motor 82 and the operating speed of winch 66. In FIG. 1, a pair of valves 88 and 90 are shown coupled to each end section 34 for permitting an operator at each end of the subgrading machine to independently control each winch. In an alternative embodiment, a single hydraulic control panel may be provided at one end of the subgrading machine to permit a single operator to control the operation of both winches.

Referring now to FIGS. 6, 7, 8 and 9, a trench grader attachment 92 can be coupled to the outer section of grader blade 22 to create an increasing depth subgrade as the grading blade spacing from forms 58 decreases. Such an increasing depth subgrade contour is necessary where heavy load bearing structures will be placed around the perimeter of the concrete slab. The increased slab thickness around the perimeter of the slab provides the required increased load bearing capacity. To permit trench grader attachment 92 to be readily coupled to or detached from grading blade 22, a pair of spaced apart hinge assemblies 94 are formed from a first hinge element 96 which is welded to the face of grading blade 22 and a second hinge element 98 which is welded to the upper section of trench grader attachment 92. A hinge pin 100 extends through hinge elements 96 and 98 and securely couples hinge grader element 92 to grading blade 22.

Figure 10:
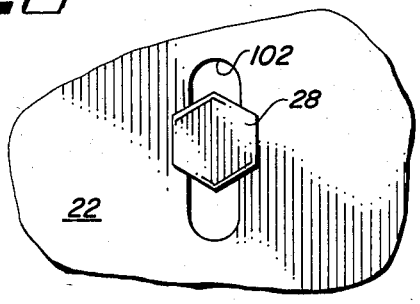
FIG. 10 is an enlarged elevational view of the grading blade depicted in FIG. 4.
Figure 9:
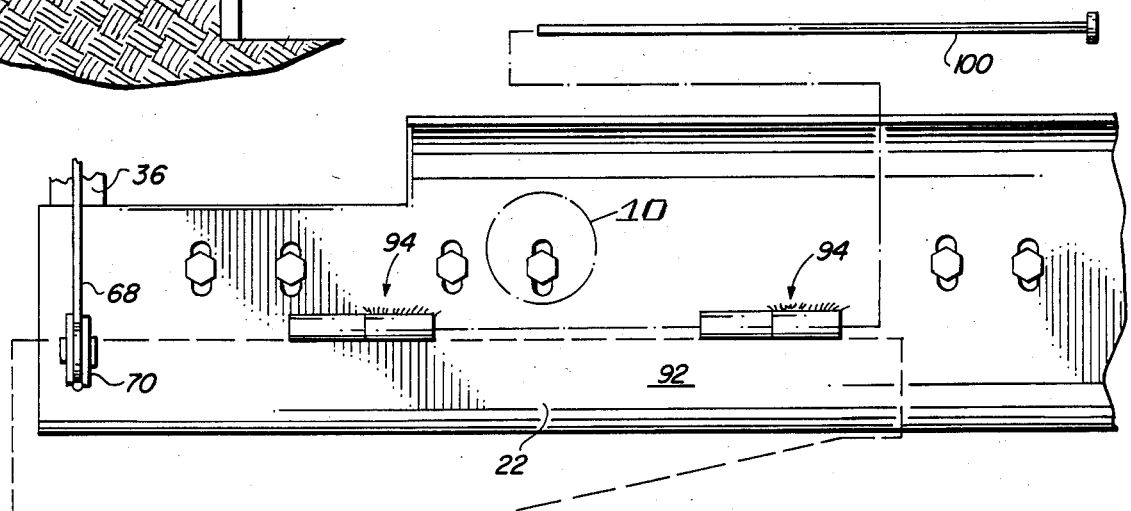
FIG. 9 is an elevational view of the trench grader attachment depicted in FIG. 7.

FIG. 10 indicates that an oval aperture 102 may be incorporated into grader blade 22 to allow vertical adjustment to provide specific subgrade contours.

Numerous different versions of the disclosed embodiments of the present invention utilizing somewhat different components and different structural arrangements would be readily apparent to one of ordinary skill in the art and would not deviate from the scope of the present invention. Accordingly, it is intended by the appended claims to cover all such modifications of the invention which fall within the true spirit and scope of the invention.

I claim:

1. A subgrading machine for precisely levelling and contouring the subgrade within an area having first and second parallel-oriented forms including parallel upper surfaces vertically spaced above the subgrade and defining a form surface plane, comprising:

a. a triangular truss frame having a length less than the spacing between the first and second forms, a linear, load bearing front edge, and a linear, load bearing rear edge spaced apart from and oriented parallel to the front edge and defining a load bearing frame base plane, said frame being terminated by first and second end sections each having spaced apart front and rear surfaces extending vertically upward from the frame base plane;

b. a rigid, load bearing grading blade mechanically secured to and extending along the load bearing front edge of said frame for engaging the subgrade, said blade including a curved blade section having an upper surface extending above the frame base plane and a lower surface protruding below the frame base plane;

c. an adjustable end bracket coupled to the front and rear surfaces of each of said end sections for controlling the elevation of the frame to position the frame base plane below the form surface plane and for transferring the weight of said frame to the upper surface of said forms, including i. form contact means extending laterally outward from said end sections and having a lower surface contacting the upper surface of the adjacent forms for maintaining a parallel alignment between the frame base plane and the form surface plane;

ii. a first roller assembly having first and second spaced apart cylindrical rollers rotatably coupled to the lower surface of said form contact means for establishing rolling contact between said adjustable end bracket and the upper surface of an adjacent form, wherein each of said rollers includes an axis of rotation oriented parallel to the front edge of said frame;

iii. frame elevation control means for coupling said form contact means to said end section at a selectable vertical position to vary the spacing between the frame base plane and the form surface plane to thereby determine the grading depth of said grading blade with respect to the subgrade; and d. a winch system for advancing the machine into the uncontoured subgrade, including i. first and second winches coupled to the end sections of said frame for reeling in first and second winch cables to generate a traction force;

ii. first and second pulleys coupled to the ends of said frame at an elevation intermediate to the upper and lower surfaces of said grading blade for lowering the elevation of the traction force exerted on said frame by said winch cables to a level in proximity to the subgrade and for causing the traction force to be distributed along the length of the load bearing front edge of said frame and through said grading blade into the subgrade to level and contour the subgrade as the machine is advanced by said winch system.

2. The subgrading machine of claim 1 further including a backing plate coupled between the grading blade and the front edge of the frame to reinforce the grading blade.

3. The subgrading machine of claim 1 wherein said adjustable end bracket further includes an outrigger bracket for engaging the upper surface of an adjacent form at a location spaced ahead of said grading blade for restricting forward tilting of said frame as said machine is advanced into the uncontoured subgrade.

4. The subgrading machine of claim 3 wherein said vertical coupling means maintains the center of gravity of said machine below the level of the form surface plane.

5. The subgrading machine of claim 3 wherein said form contact means includes a contact zone for engaging the adjacent form and wherein said adjustable end bracket further includes lateral adjustment means for varying the spacing between the contact zone and the end section of said frame.

6. The subgrading machine of claim 3 wherein said adjustable end bracket further includes a second roller assembly positioned below said outrigger bracket for establishing rolling engagement between said outrigger bracket and the upper surface of said form.

7. The subgrading machine of claim 3 wherein each of said end sections includes first and second parallel, vertically oriented support rails and wherein said coupling means secures said form contact means to said first and second support rails to prevent relative angular rotation of the frame base plane with respect to the form surface plane.

8. The subgrading machine of claim 1 further including a hydraulic system for actuating said winch system, said hydraulic system including:

a. an internal combustion engine having a drive shaft;

b. a hydraulic pump coupled to said drive shaft for transmitting pressurized fluid through an output port;

c. a first hydraulic motor coupled to the output port of said hydraulic pump for actuating said first winch;

d. a second hydraulic motor coupled to the output port of said hydraulic pump for actuating said second hydraulic motor; and e. hydraulic control means for actuating said first and second hydraulic motors.

9. The subgrading machine of claim 8 wherein said hydraulic control means further controls the operating speed of said first and second hydraulic motors.

10. The subgrading machine of claim 8 wherein said internal combustion engine is coupled to the center of said frame.

11. The subgrading machine of claim 1 further including a trench grader attachment coupled to the outboard section of the front edge of said frame for forming a subgrade contour of increasing depth as the distance between said frame and the adjacent form decreases.

12. The subgrading machine of claim 11 wherein said trench grader attachment extends beyond the end section of said frame toward the adjacent form.

13. The subgrading machine of claim 11 further including means for detachably coupling said trench grader attachment to said subgrading machine.

14. The subgrading machine of claim 13 wherein said trench grader attachment is coupled below the midsection of said grading blade.

15. The subgrading machine of claim 1 wherein said grading blade includes a straight, vertically oriented central section, an upper section curved in a forward direction, and a lower section curved in a forward direction.

16. The subgrading machine of claim 15 wherein the upper section of said grading blade is a mirror image of the lower section.

17. The subgrading machine of claim 16 wherein said grading blade includes upper and lower cutting edges having serrated cutting teeth.

18. The subgrading machine of claim 15 wherein said grading blade includes a plurality of horizontally aligned, oval-shaped apertures for coupling said grading blade to said frame and for permitting relative vertical adjustments of said grading blade with respect to said frame to modify the contour imparted to the subgrade by said machine.

19. The subgrading machine of claim 18 wherein said grading blade is fabricated in sections and wherein each of said grading blade sections is independently adjustable with respect to said frame.

* * * * *